US010526872B2

(12) United States Patent
Vachon

(10) Patent No.: US 10,526,872 B2
(45) Date of Patent: Jan. 7, 2020

(54) ICD OPTIMIZATION

(71) Applicant: The ConocoPhillips Company, Houston, TX (US)

(72) Inventor: Guy Vachon, Houston, TX (US)

(73) Assignee: ConocoPhillips Company, Houston, TX (US)

( * ) Notice: Subject to any disclaimer, the term of this patent is extended or adjusted under 35 U.S.C. 154(b) by 512 days.

(21) Appl. No.: 15/260,991

(22) Filed: Sep. 9, 2016

(65) Prior Publication Data

US 2017/0314367 A1 Nov. 2, 2017

Related U.S. Application Data

(60) Provisional application No. 62/216,672, filed on Sep. 10, 2015.

(51) Int. Cl.

| | |
|---|---|
| ***G06F 17/50*** | (2006.01) |
| ***E21B 41/00*** | (2006.01) |
| ***E21B 43/08*** | (2006.01) |
| ***E21B 47/06*** | (2012.01) |
| ***E21B 49/00*** | (2006.01) |
| ***E21B 49/08*** | (2006.01) |
| *E21B 43/24* | (2006.01) |

(52) U.S. Cl.

CPC ..... *E21B 41/0092* (2013.01); *E21B 43/08* (2013.01); *E21B 47/06* (2013.01); *E21B 47/065* (2013.01); *E21B 49/00* (2013.01); *E21B 49/08* (2013.01); *E21B 43/2406* (2013.01); *E21B 2049/085* (2013.01)

(58) Field of Classification Search

CPC .... E21B 41/0092; E21B 43/08; E21B 47/065; E21B 49/00; E21B 49/06; E21B 2049/085; E32B 43/2406

USPC ..... 703/10

See application file for complete search history.

(56) References Cited

U.S. PATENT DOCUMENTS

2011/0295581 A1* 12/2011 Montaron ..... E21B 43/00 703/10
2012/0278053 A1* 11/2012 Garcia ..... E21B 43/00 703/10
2014/0262235 A1 9/2014 Rashid

OTHER PUBLICATIONS

Bernt S. Aadnoy, Geir Hareland, "Analysis of Inflow Control Devices", 2009 SPE Offshore Europe Oil & Gas Conference & Exhibition held in Aberdeen, UK, Sep. 8-11, 2009, SPE 122824, pp. 1-9.*

Polina Minulina, Shahin Al-Sharif, George Zeito, "The Design, Implementation and Use of Inflow Control Devices for Improving the Production Performance of Horizontal Wells" SPE International Production and Operations Conference and Exhibition held in Doha Qatar, May 14-16, 2012. SPE 157453, pp. 1-15.*

Zhuoyi Li, Preston Fernandes, D. Zhu, "Understanding the Roles of Inflow-Control Devices in Optimiziing Horizontal-Well Performance" SPE Annual Technical Conference and Exhibition, New Orleans, Louisiana, USA Oct. 4-7, 2009. Publication date Oct. 2009, SPE 124677, pp. 376-385.*

Zeng G., et al. Comparative Study on Passive Inflow Control Devices by Numerical Simulation, Tech Science Press SL 9(3):169-180 (2013).

Youngs, B. et al., Multisegment well modeling optimizes inflow control devices, World Oil (May 2010), p. 37-42.

* cited by examiner

*Primary Examiner* — Dwin M Craig

(74) *Attorney, Agent, or Firm* — Boulware & Valoir

(57) ABSTRACT

A method of optimization ICD design that includes consideration of reservoir characteristics, well configuration and type of enhanced oil recovery technique, as well as needed performance characteristics. Thus, the ICD is optimized for particular wells, reservoirs and/or enhanced oil recovery uses.

10 Claims, 3 Drawing Sheets

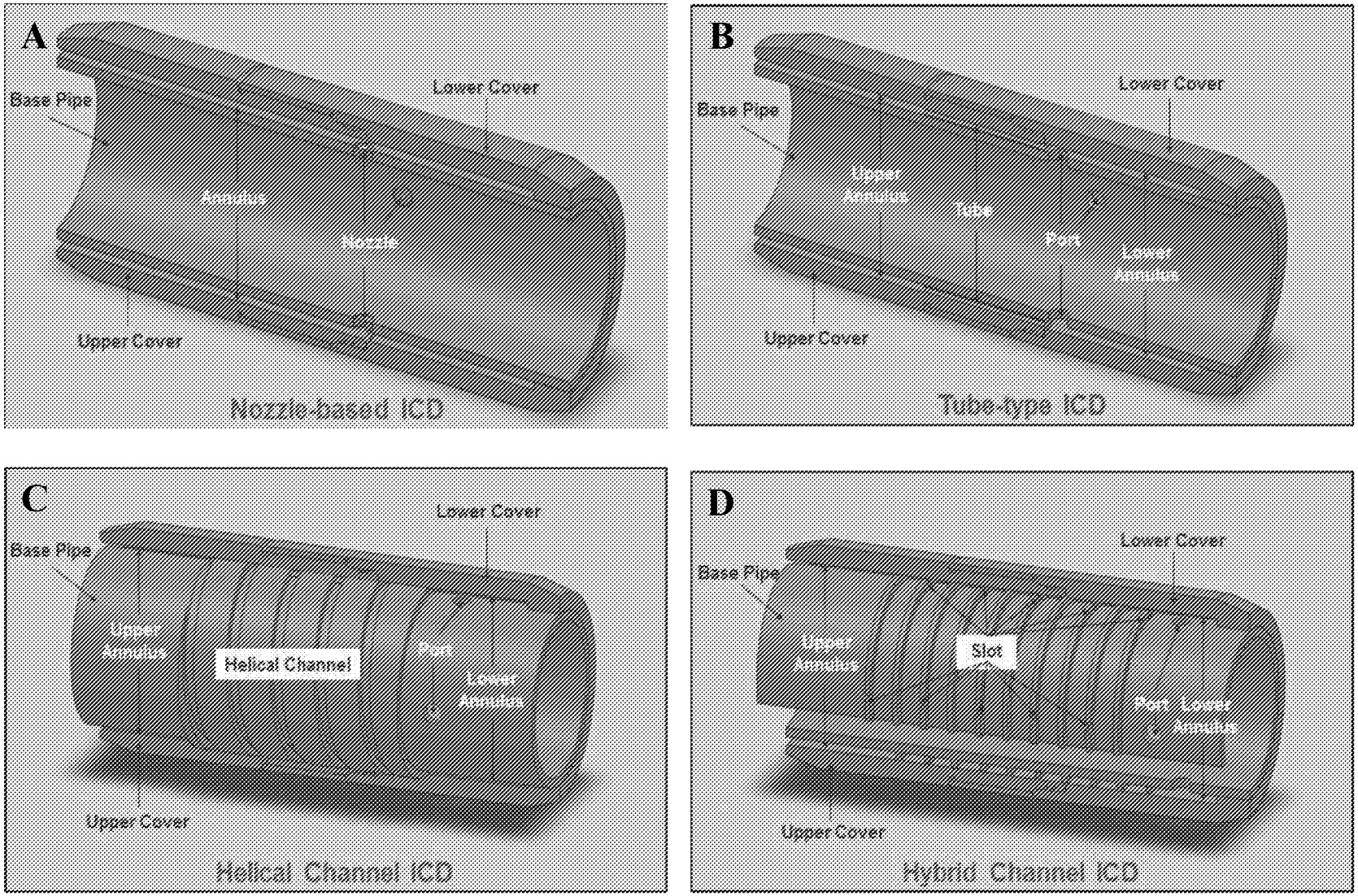
Figure 1: PRIOR ART

A
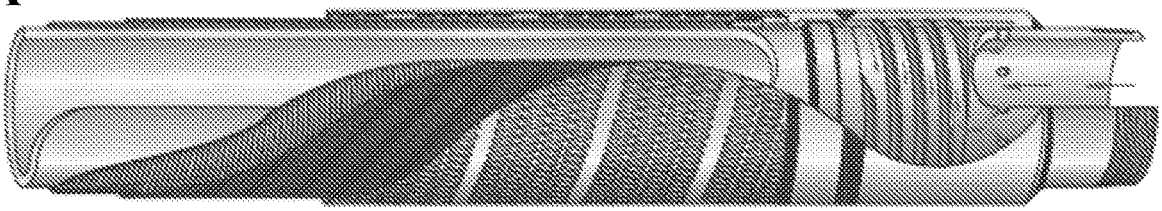
Channel ICD schematics (courtesy Baker Oil Tools)
B
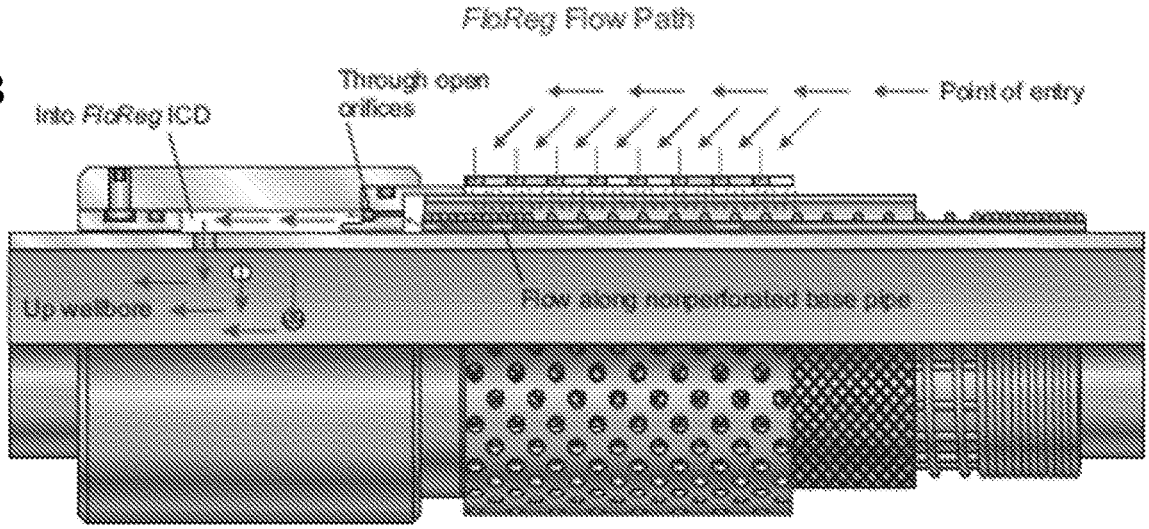
Orifice ICD schematics (courtesy Weatherford)
Figure 2: PRIOR ART

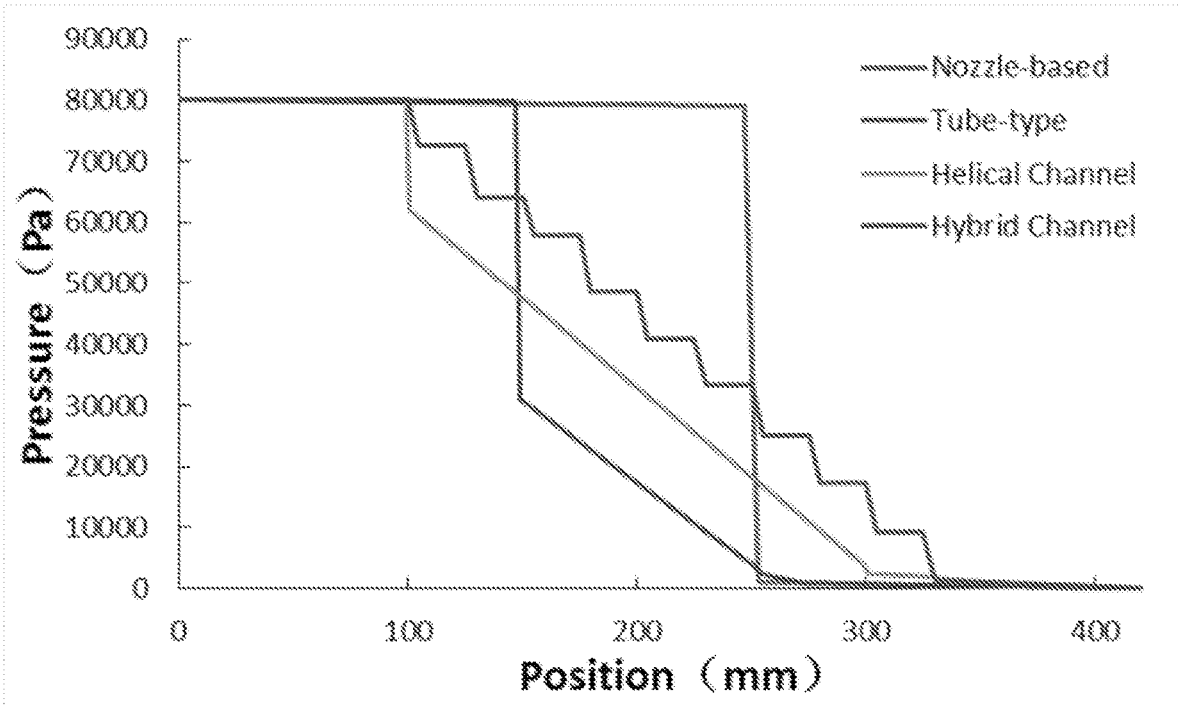
Figure 3: PRIOR ART

ICD OPTIMIZATION

PRIOR RELATED APPLICATIONS

This application is a non-provisional application which claims benefit under 35 USC § 119(e) to U.S. Provisional Application Ser. No. 62/216,672 filed Sep. 10, 2015, entitled "ICD OPTIMIZATION," which is incorporated herein in its entirety.

FEDERALLY SPONSORED RESEARCH STATEMENT

Not applicable.

FIELD OF THE DISCLOSURE

The disclosure generally relates to inflow control devices, and in particular to the design of optimized ICDS for particular uses.

BACKGROUND OF THE DISCLOSURE

As drilling technology improves, longer and longer wells are being drilled. The worlds' longest drilled oil well is BD-04-A, completed in May 2008 by Maersk Oil Qatar and Qatar Petroleum, in the Al-Shaheen offshore oil field off the coast of Qatar. The well includes a horizontal section measuring 35,770 ft (more than 6 miles).

Increasing well-reservoir contact via longer wells has a number of potential advantages in terms of well productivity, drainage area, sweep efficiency and delayed water or gas break-through. However, long wells not only bring advantages, but also present new challenges in terms of drilling, completion and production.

One of these challenges is the frictional pressure losses increase with well length. The inflow profile becomes distorted so that the heel part of the well produces more fluid than the toe when these losses become comparable to drawdown. This inflow imbalance, in turn, often causes premature water or gas breakthrough, which is highly undesirable.

Installation of an Inflow Control Devices or ICDs is an advanced well completion option that provides a practical solution to this challenge. An ICD is a device that directs the fluid flow from the annulus into the base pipe via a flow restriction. This restriction can be in form of tubes, helical channels, nozzles/orifices or a hybrid design (FIG. 1A-D).

In all cases, the ability of an ICD to equalize the inflow along the well length is due to the divergence in the physical laws governing fluid inflow in the reservoir and through the ICD. Liquid inflow in porous media is normally laminar, hence there is a linear relationship between the flow velocity and the pressure drop. By contrast, the flow regime through an ICD is turbulent, resulting in a quadratic velocity/pressure drop relationship.

The physical laws of flow through an ICD make it especially effective in reducing the free gas production. In situ gas viscosity under typical reservoir conditions is normally at least an order of magnitude lower than that of oil or water; while in situ gas density is only several times smaller than that of oil or water. Gas inflow into a well will thus dominate after the initial gas breakthrough if it is not restricted by gravity or an advanced completion.

ICDs introduce an extra pressure drop that is proportional to the square of the volumetric flow rate. The dependence of this pressure drop on fluid viscosity is weak for channel devices and totally absent if nozzle or orifice ICDs are used. These characteristics enable ICDs to effectively reduce high velocity gas inflow. The magnitude of a particular ICD's resistance to inflow depends on the dimensions of the installed nozzles or channels. This resistance is often referred to as the ICD's "strength." It is set at the time of installation and cannot be changed without a major intervention to recomplete the well.

ICDs have been installed in hundreds of wells during the last decade, being now considered to be a mature, well completion technology. Steady-state performance of ICDs can be analyzed in detail with well modeling software.

We have found that ICDs work well in SAGD wells because of the phenomenon of steam blocking. The velocity of fluids increases when steam begins to break through and the differential pressure across the ICD ($\Delta P$) increases, effectively blocking the steam from being produced. The problem is that all available ICDs were designed with the conventional oil production in mind, not SAGD or the many variants thereon, such as fishbone SAGD, radial SAGD, Cross SAGD (XSAGD), single-well SAGD (SW-SAGD), expanding solvent SAGD (ES-SAGD), Steam And Gas Push (SAGP), SAGD wind down, Fast SAGD, as well as in other enhanced recovery methods, such as Cyclic Steam Stimulation (CSS), High pressure cyclic steam stimulation (HPCSS), Vapor Extraction (Vapex), and the like.

Thus, what is needed in the art are methods of optimizing ICD design for these various enhanced oil recovery techniques.

SUMMARY OF THE DISCLOSURE

The disclosure relates generally to a method of optimizing ICD design that includes not just ICD characteristics, but the characteristics of the given reservoir as well as the well configuration and enhanced oil recovery (EOR) technique that is being used. With this methodology, the ICDs can be specifically designed e.g., for unconventional deposits, such as oil sands, artic oil sands, thin, stacked payzones, and the like.

The ICD design can also be optimized for the chosen EOR technique being used, such as SAGD or the many variants thereon, such as fishbone SAGD, radial SAGD, Cross SAGD (XSAGD), single-well SAGD (SW-SAGD), expanding solvent SAGD (ES-SAGD), Steam And Gas Push (SAGP), SAGD wind down, Fast SAGD, as well as in other enhanced recovery methods, such as Cyclic Steam Stimulation (CSS), High pressure cyclic steam stimulation (HPCSS), Vapor Extraction (Vapex), and the many variations thereon.

The technique is to develop mathematical models that predict figures of merit as a function of physical design parameters of the ICD like length and depth of channels, number of elements, roughness of surfaces, diameter of orifices, etc.

In more detail, the invention includes any one or more of the following embodiments in any combination(s) thereof:

A method of optimizing the inflow control device (ICD) design, said method comprising: a) inputting reservoir feature attributes including permeability, porosity, viscosity, temperature, and pressure; b) inputting well configuration attributes including well length, diameter, slot size, branching, depth, vertical and lateral separation between producer wells and injector wells, and relative orientation of producer wells and injector wells; c) inputting enhanced oil recovery attributes including steam injection rate, steam quality, and steam injection pressure; d) inputting variable attributes for an ICD including number of orifices or channels, diameter of orifices or channels, number of bends, and degree of bending; e) inputting an objective function containing desired performance characteristics; f) applying a function Fq to combine all attributes into a figure of merit for ICD and comparing with said objective function in step e; and g) applying a software optimizer to generate an optimal Fq for the inputted attributes, wherein the variable attributes in step d) are varied so that said optimal Fq most closely approaches the objective function in step e.

A method of optimizing an inflow control device (ICD) design, said method comprising: a) inputting into a computer program a plurality of reservoir feature attributes from a reservoir including permeability, porosity, viscosity of oil in place, downhole temperature, downhole pressure, and geologic model; b) inputting into said computer program a plurality of well configuration attributes including well length, diameter, slot size, branching, depth, vertical and lateral separation between producer wells and injector wells, undulations, relative orientation of producer wells and injector wells, number and type of ICDs used, configuration of production tubing, and artificial lift system; c) inputting into said computer program a plurality of enhanced oil recovery attributes including steam injection rate, steam quality, steam injection pressure, steam injection temperature, percentage of solvent coinjected; d) inputting into said computer program a plurality of variable attributes for an ICD including number of orifices or channels, diameter of orifices or channels, number of bends, and degree of bending; e) inputting into said computer program one or more objective functions containing desired performance characteristics; f) applying in said computer program a function Fq to combine all attributes into one or more figures of merit and comparing with said objective function in step e, wherein said figures of merit include at least flow rate sensitivity, viscosity sensitivity, and steam block efficiency; and g) optimizing in said computer program to generate an optimal Fq for the inputted attributes, wherein the variable attributes in step d) are varied so that said optimal Fq most closely approaches the objective function in step e.

A method as herein described, wherein the figures of merit include flow rate sensitivity, viscosity sensitivity, and steam block efficiency.

A method as herein described, wherein the figures of merit include density sensitivity.

A method as herein described, wherein a spreadsheet, preferably Excel VBA is used in the method.

A method as herein described, wherein Excel Solver functionality is used in step g).

A method as herein described, further comprising manufacturing a plurality of optimal ICDs employing said optimal Fq.

A method as herein described, further comprising installing said manufactured ICDs in said reservoir.

An ICD designed by the methods described herein.

A well completed with one or more ICDs designed by the methods described herein.

As used herein a "Figure of Merit" is a quantity used to characterize the performance of a device, system or method, relative to its alternatives. The Figures of Merit that we use are flow rate sensitivity (how quickly does ΔP increase with flow rate), viscosity sensitivity (how quickly does ΔP increase with viscosity) and steam block (how quickly does ΔP increase when steam breaks through and as steam quality increases). This disclosure also mentions sensitivity to density, which is valid, although it does not differentiate performance in SAGD wells.

By "Fq" what is meant is a function that combines the figures of merit or KPIs into a value that can be optimized. It could be as simple as the sum of the KPIs or as complicated as the resulting improvement in NPV of a well equipped with ICDs with said figures of merit.

By "software optimization" or similar language what is meant is running a software program to arrive at the best possible value of Fq. A large list of available optimization programs (free, open source, and proprietary) are available at wikipedia under "list of optimization software," incorporated by reference herein in its entirety for all purposes. Optimization programs may include ADMB, ALGENCAN, APMonitor, ASCEND, BOBYQA, COBYLA, CONDOR, COIN-OR SYMPHONY, CUTEr, dlib, EvA2, GLPK, IPOPT, JOptimizer, JuliaOpt, L-BFGS, Liger, LINCOA, MIDACO, MINUIT/MINUIT2, NEWUOA, NLopt, NOMAD, OpenMDAO, OpenOpt, OptaPlanner, PPL, Scilab, TAO, TOLMIN, UOBYQA, and the like.

An optimization problem, e.g., a minimization problem, can be represented in the following way:

Given: a function f: A→to R from some set A to the real numbers

Search for: an element x0 in A such that $f(x0) \leq f(x)$ for all x in A.

In continuous optimization, A is some subset of the Euclidean space Rn, often specified by a set of constraints, equalities or inequalities that the members of A have to satisfy. In combinatorial optimization, A is some subset of a discrete space, like binary strings, permutations, sets of integers.

The use of optimization software requires that the function f is defined in a suitable programming language and connected at compile or run time to the optimization software. The optimization software will deliver input values in A, the software module realizing f will deliver the computed value f(x) and, in some cases, additional information about the function like derivatives.

In this manner, a clear separation of concerns is obtained: different optimization software modules can be easily tested on the same function f, or a given optimization software can be used for different functions f.

By "reservoir feature attributes" what is meant are those measured attributes that characterize a reservoir, such as permeability, porosity, viscosity of oil in place, downhole temperature, downhole pressure, geologic model and the like.

By "well configuration attributes" what is meant are those characteristics that describe the well set up, such as a SAGD well pair, or cross SAGD well array. Included are such characteristics as well length, diameter, slot size, branching, orientation, depth, undulations, vertical and/or lateral separation between producer wells and injector wells and number and type of ICDs used in the completion, configuration of production tubing, artificial lift system, and the like.

By "enhanced oil recovery attributes" what is meant are those characteristics the described the EOR technique being used. Such characteristics include steam injection rate, steam quality, steam injection pressure, the proportion of solvents or gases co-injected with the steam, and the like.

By "variable attributes" what is meant is that these variables can be changed in an optimization protocol to achieve the objective function. In this case we refer to attributes of the ICD design that can be varied, such as number of orifices, number of channels, diameter of orifices, diameter (or width and depth) of channels, shape of orifices or channels, number of bends, degree of bending, rugocity, corrosiveness or resistance thereto, and the like.

By "objective function" what is meant is Fq, the function that maps the desired performance characteristics into a value that can be optimized.

By "inflow control devices" or "ICDs" what is meant is a passive well completion device that restricts the fluid flow from the annulus into the base pipe. The restriction can be in form of channels or nozzles/orifices or combinations thereof, but in any case the ability of an ICD to equalize the inflow along the well length is due to the difference in the physical laws governing fluid flow in the reservoir and through the ICD. By restraining, or normalizing, flow through high-rate sections, ICDs create higher drawdown pressures and thus higher flow rates along the bore-hole sections that are more resistant to flow. This corrects uneven flow caused by the heel-toe effect and heterogeneous permeability.

The use of the word "a" or "an" when used in conjunction with the term "comprising" in the claims or the specification means one or more than one, unless the context dictates otherwise.

The term "about" means the stated value plus or minus the margin of error of measurement or plus or minus 10% if no method of measurement is indicated.

The use of the term "or" in the claims is used to mean "and/or" unless explicitly indicated to refer to alternatives only or if the alternatives are mutually exclusive.

The terms "comprise", "have", "include" and "contain" (and their variants) are open-ended linking verbs and allow the addition of other elements when used in a claim.

The phrase "consisting of" is closed, and excludes all additional elements.

The phrase "consisting essentially of" excludes additional material elements, but allows the inclusions of non-material elements that do not substantially change the nature of the invention, such as instructions for use, different coding platforms, different computing configurations, and the like.

The following abbreviations are used herein:

| ABBREVIATION | TERM |
|---|---|
| CSOR | Cumulative steam to oil recovery |
| CSS | Cyclic Steam Stimulation |
| EOR | Enhanced oil recovery |
| FRR | flow resistance rating |
| HPCSS | High pressure cyclic steam stimulation |
| ICD | Inflow control device |
| SAGD | Steam assisted gravity drainage |
| SAGP | Steam assisted gravity and gas push |
| SOR | steam to oil recovery |
| VAPEX | Vapor Extraction |
| XSAGD | Cross SAGD |
| ADMB | automatic differentiation nonlinear optimization framework, |
| ALGENCAN | general nonlinear programming interface |
| APMonitor | Mixed Integer Nonlinear Programming Solvers |
| ASCEND | Mathematical modelling system |
| BOBYQA | least value of a nonlinear function subject to bound constraints |
| COBYLA | least value of a nonlinear function subject to nonlinear inequality constraints |
| CONDOR | Non-linear Continuous Objective Function for small dimension (n < 20) with linear and non-linear constraints |
| COIN-OR SYMPHONY | integer programming |
| CUTEr | optimization and linear algebra solvers test environment |
| dlib | C++ library of linear and non-linear solvers |
| EvA2 | Evolutionary algorithms framework |
| GLPK | GNU Linear Programming Kit |
| IPOPT | large scale nonlinear optimization for continuous system |

-continued

| ABBREVIATION | TERM |
|---|---|
| JOptimizer | Java library for convex optimization |
| JuliaOpt | Julia environment optimization libraries |
| L-BFGS | limited-memory quasi-Newton optimization |
| Liger | single and multi-objective nonconvex integrated optimization |
| LINCOA | least value of a nonlinear function subject to linear inequality constraints |
| MIDACO | Limited Version, MINLP, Global Optimization Parallelization |
| MINUIT/MINUIT2 | multivariate function minimizer for real-valued functions with analytic or numerical gradients |
| NEWUOA | unconstrained optimization |
| NLopt | many algorithm, many language bindings, global and local optimizers |
| NOMAD | generic optimization package |
| OpenMDAO | Multidisciplinary Design, Analysis, and Optimization framework, |
| OpenOpt | numerical optimization framework |
| OptaPlanner | optimization heuristics and metaheuristics planning engine |
| PPL | integer programming problems, polyhedra |
| Scilab | cross-platform numerical computational programming language |
| TAO | large-scale parallel algorithm optimization |
| TOLMIN | minimizes general differentiable nonlinear function subject to linear constraints |
| UOBYQA | unconstrained optimization algorithm |

BRIEF DESCRIPTION OF THE DRAWINGS

FIG. 1 Shows the four basic Passive ICD designs. A Shows a Nozzle based ICD. B shows a Tube type ICD. C shows a Helical channel ICD. D shows a Hybrid channel ICD.

FIG. 2 shows Commercially available ICDs with exterior sand screens. A is a helical channel type ICD from Baker Hughes, and B is a nozzle type device from Weatherford.

FIG. 3. Pressure distribution graph for the four types of ICD (pressure Pa v. distribution mm).

DETAILED DESCRIPTION

The disclosure provides novel methods of optimizing ICD design wherein an objective function that captures all the desired behaviors is constructed and an optimization routine determines the values of the design parameters that optimize this objective function.

Currently, there are four different Passive ICD designs in the industry: nozzle-based, helical channel, tube-type and hybrid channel. See FIG. 1A-D. They respectively use restriction mechanism (nozzle-based), friction mechanism (helical channel) or both mechanisms (tube-type and hybrid channel) to achieve a uniform inflow profile. Further, many ICDs are combined with sand control screens. See e.g., FIG. 2. The pressure drop patterns of each of these types of ICD are shown in FIG. 3.

However, the reality is that none of these ICDs alone meets the ideal requirements of an ICD designed for the life of the well: high resistance to plugging and erosion, high viscosity insensitivity. Therefore, the selection and optimization of ICDs for a specific reservoirs, especially steam developed reservoirs, are still required to be further studied.

The nozzle-based ICD (FIG. 1A) uses fluid constriction to generate an instantaneous differential pressure across the ICD. The device forces the fluid from a larger area down through small diameter ports, creating a flow resistance. The benefits of nozzle-based ICD are its simplified design and easier adjustment immediately before use in a well should real-time data indicate that adjustment is needed. However, the small diameter ports make it prone to erosion from high-velocity fluid-borne particles during production as well as prone to plugging, especially during any period where mud flow back occurs.

The helical channel ICD uses surface friction to generate a differential pressure across the device. The helical channel design has one or more flow channels that wrapped around a base pipe, and provides for a distributed pressure drop over a relatively long area, versus the instantaneous loss using a nozzle. Because the larger cross-sectional flow area of the helical channel, this ICD generates significantly lower fluid velocity than the nozzles of a nozzle-based ICD with a same flow resistance rating (FRR). The helical channel ICD is also more resistance to erosion and plugging. The disadvantage of helical-channel ICD is that its flow resistance is more viscosity-dependent than the nozzle-based ICD, which could allow preferential water flow should premature water breakthrough occur.

The tube-type ICD design incorporates a series of tubes, and the primary pressure drop mechanism is restrictive, but in long tubes. This method essentially forces the fluid from a larger area down through the long tubes, creating a flow resistance. Because of the additional friction resistance, the larger cross-sectional flow area of the tube-type ICD generates lower fluid velocity than the nozzles of a nozzle-based ICD with the same FRR. Thus, the tube-type ICD is more resistance to erosion and plugging. However, since the frictional resistance is much less than the local resistance, the tube-type ICD is less viscosity-dependent than the helical channel ICD with the same FRR.

The hybrid ICD design incorporates a series of flow slots in a maze pattern. Its primary pressure drop mechanism is restrictive, but in a distributive configuration. A series of bulkheads are incorporated in the design, each of which has one or more flow cuts at an even angular spacing. Each set of flow slots is staggered with the next set of slots with a phase angle. Thus, the flow must turn after passing through each set of slots. This prevents any jetting effect on the flow path of the downstream set of slots which may induce turbulence. As the production flow passes each successive chamber that is formed by bulkheads, a pressure drop is incurred, and pressure is reduced in a step like manner. Without the need to generate an instantaneous pressure drop, the flow areas through the slots are relatively large when compared to the nozzle design of same FRR, thus dramatically reducing erosion and plugging potential.

Zeng et al (2013) modeled the performance of each of these ICD types. Four numerical models of these ICDs with same flow rating resistance were developed to characterize the flow performance based on computational fluid dynamics. Their results showed that the throttle pressure drop depends mainly on fluid properties, flow rate and geometry parameters of each ICD. For all four ICDs, the throttle pressure drop increases along with fluid viscosity, density and flow rate. The helical channel ICD occupies first place with corrosion resistance, while hybrid channel ICD has least viscosity sensitivity. The parameter optimization of each ICD was researched as well. For a specific reservoir, we will have the ICD with a best pressure drop composition by optimizing its structural parameter, which has a best corrosion resistance and least viscosity sensitivity.

However, these engineers did not take gravity into effect in their modeling, asserting that gravity was negligible. Thus, their efforts were not optimized for use in enhanced oil recovery techniques that employ a gravity drive. Another principle difference is that they did not account for what happens in an ICD when pressure drop across them causes water to flash, and the mixture changes to incorporate an increasing amount of gas. They also did not account for what happens when there is some steam at the inlet of the ICD and how that amount of steam increases as pressure drops through the ICD. Thus they could not even begin to account for the most important KPI when ICDs are used in SAGD producers, which is steam block.

Each ICD has an architecture with a number of physical dimensions or properties that determine their performance: P1, P2, P3, P4, etc. These will affect a series of physical attributes A1, A2, A3, A4, etc. such that An=Fn(P1, P2, P3, P4, . . . ). The parameters P1, P2, P3, P4, etc. could be dimensions of physical features like the width or length of a gap, they could be physical features like the rugosity (a measure of small-scale variations or amplitude in the height of a surface) or the severity of a bend, or they could be attributes like the count of features (how many orifices or channels) or any such variable that impacts the performance of the ICD.

The attributes AI, A2, A3. A4. etc. are the performance characteristics of the tool that make it more or less appropriate for a SAGD or variant application. For example, how sensitive is ΔP to viscosity (μ), to mass rate (rh), to density (ρ) or to steam quality (SQ). A function Fq(A1, A2. A3. A4 . . . ) is constructed to combine these attributes into a figure of merit for FCD. Note that Fq can be made generic but can also be tailored to a specific application. A generic Fq can be defined for a family of FCDs independent of application.

A specific Fq can be defined for one application with given rate/temperature/bitumen type parameters. In either case a software optimizer can be used to ascertain the values of PI, P2, P3, P4, etc. that yield the optimal value for Fq.

The principal advantage of the invention is that it enables the design of an ICD that has optimal performance characteristics for a class of applications (like SAGD parallel wells in general or SAGD fishbone wells, etc.) where the ICD configuration should be tuned to specific wells or for a given application. The general configuration can be defined and built on several ratings before the individual well requirements are known at the expense of fine tuning for each well. It is also possible to fine tune a configuration to where it is the very best configuration possible for a given installation.

The present invention is exemplified with respect to helical channel type ICDs used for conventional SAGD. However, this is exemplary only, and the invention can be broadly applied to any ICD type and any particular reservoir, and any type of enhanced oil recovery.

The following examples are intended to be illustrative only, and not unduly limit the scope of the appended claims.

Modeling a Simple FCD Model

ΔP estimation for flow through orifices in turbulent flow:

$$\Delta P = K \times \rho \times V^2 = K \times \frac{w^2}{\rho \times A^2} \quad \text{Eq. 1}$$

Where:

ΔP is the pressure drop across an orifice in psi

K is a dimensionless friction factor which is a function of Re and will be determined empirically ρ is the fluid's mass density in $kg/m^3$
V is the fluid's velocity in m/s
w is the fluid's mass flow in kg/s
A is the conduit's cross sectional area in $m^2$.

$$Re = \frac{d \times V \times \rho}{\mu} \quad \text{Eq. 2}$$

Where
d=internal diameter (mm)
V is the fluid's velocity in m/s
ρ is the fluid's mass density in $kg/m^3$
μ=dynamic viscosity in centipoises (cP)

Formula to fit K to Re will be determined empirically but one approximation that has been used in mono-phase flow $$K = f_1 + \frac{f_1 + f_2}{\left(1 + \left(\frac{Re}{t}\right)^{c,d}\right)} \quad \text{Eq. 3}$$

Where
$f_1 = a_1 \times Re^{b_1}$
$f_2 = a_2 \times Re^{b_2}$
$a_1$, $a_2$, $b_1$, $b_2$, c, d and t are empirical factors based on flow testing By way of example, the FCD model may include a polynomial equation, an exponential equation, a logarithmic equation, a ratio of polynomials or a combination thereof. Such tool equations used for the FCD model would be fit to minimize a measure of error such as mean square error, median error or maximum error on a measured data set or results of a CFD simulation or a history match on a known well. The FCD model may further describe the physics of the flow through the FCD. For example, the FCD model may include use of a Bernoulli equation to predict the differential pressure, such as the following:

$$\Delta P = K\rho v^2, \quad \text{Eq. 4}$$

where ΔP is the differential pressure, ρ is the density of the fluid, v is the velocity of the fluid and K is a function Reynolds number (Re), which depends on velocity, density and viscosity of the fluid and specific properties of the FCD, which may differ for various designs of the FCD.

Value for the K can be modeled using a polynomial equation, an exponential equation, a logarithmic equation or a ratio of polynomials. While the steam quality aspect of the value for the K can also be fit to the behavior that matches performance of the FCD, an exemplary fit describes the physics of the FCD having a particular design and without being a function of the steam quality, as set forth by:

K=fn(Re), e.g., $$K = f1 + (f1 + f2)/(1 + (Re/t)\hat{}c)\hat{}d, \quad \text{Eq. 5}$$

where f1=a1*Reˆb1, f2=a2*Reˆb2 and a1, a2, b1, b2, c, d and t are empirical factors based on flow testing of the FCD. Therefore, the K may include fitting to include the steam quality, as represented by:

K=fn(Re, steam fraction), e.g., $$K = (f1 + (f1 + f2)/(1 + (Re/t)\hat{}c)\hat{}d) + x, \quad \text{Eq. 6}$$

where x is a scaled value depending on the steam quality and may be represented as a constant or another equation that provides a best answer corresponding to known data as set forth herein.

The Eq. 4, using Eq. 6 for K, enables determination of the differential pressure that may be transformed to the input parameter desired for use with the reservoir model to capture the properties that describe the flow of fluids through both the formation and the completion including the FCD. The flow rate, density, viscosity, steam quality, pressure and temperature thereby get converted into terms acceptable to describe flow through the FCD for the reservoir model. The reservoir model then outputs simulations as normal.

In some embodiments, the FCD model estimates the differential pressure resulting from the fluid passing through stages separated by chokes of the FCD. Flashing of the fluid into steam causes the volume of the fluid to increase, which increases the velocity through the FCD and thus generates incremental differential pressure. In order to account for this effect, the FCD model describes a series of the chokes separated by gaps. In the gap, the pressure decreases by the differential pressure of the choke. If the fluid is at saturation after the pressure drop of the choke, some of the fluid flashes.

Based on the foregoing, this estimation may start with a Bernoulli equation, such as Equations 1 and 2, to get the differential pressure through a first choke. Since Equations 1 and 2 lack an accounting for effect of steam flashing through the FCD, the K of the Bernoulli equation may be scaled by another equation that then estimates a fraction by mass that flashes, as set forth by:

$$(H_{Li} - H_{Lo})/(H_{Vo} - H_{Lo}), \quad \text{Eq. 7}$$

where Hu is liquid enthalpy at an inlet pressure entering the choke, $H_{Lo}$ is liquid enthalpy at an outlet pressure exiting the choke and $H_{Vo}$ is vapor enthalpy at the outlet pressure. As the vapor fraction increases, the density decreases, the viscosity changes and the fluid velocity increases. These effects can all be estimated to yield the fluid properties going into a second choke.

Calculations based on Equations 4, 5 and 6 may then be repeated n number of times to account for second and subsequent chokes and gaps. The steam fraction from previous stages combines with additional steam released at a current stage, as represented by:

$$S1 \text{ to } n-1 + (HLi - HLo)/(HVo - HLo), \quad \text{Eq. 8}$$

where $S_{1\ to\ n-1}$ is a summation of the steam fraction produced in previous stages as calculated for each stage. Value of n for the number of times to be repeated and the properties of each choke can be determined based on physical properties of the FCD, be fitted to match data from a laboratory or field test or come from other means of determining FCD performance, such as CFD analysis. For some embodiments, the FCD includes at least three of the stages and the FCD model uses a calculation through only two (i.e., n=2) of the stages such that the value of n may be less than, greater than and/or not equal to the number of the chokes in the FCD.

In one example, the FCD model converged with laboratory data when n was two even though the number of stages in the FCD was greater than two. Further iterations with n greater than two failed to provide the best result. However, convergence occurred as expected when n was the actual number of stages if not accounting for influence of the fluid flashing to the steam and thus not employing Equation 4 in the estimation of the differential pressure in the foregoing description.

As described above, the fluid properties adjusted between the chokes accounts for the fluid that is flashed into steam after each choke. This approach includes a drawback in that a single choke seems to be insensitive to the fluid flashing across, which is not correct given the flashing occurs at each step. In order to correct this, the FCD model may further include a scaling factor to the computed amount of liquid that is expected to flash on each stage, as exemplified by:

$$((HLi-HLo)/(HVo-HLo))*C, \quad \text{Eq. 9}$$

where C is the scaling factor for the amount of the steam that is released between the stages.

For embodiments where the fluid includes a mixture of oil, gas, water and steam, the FCD model may treat the fluid as an immutable stream with oil and gas moving in parallel with water and steam. The water and steam may change phase at the stages of the FCD with such phase changes accounted for by the FCD model as set forth herein. Treatment of the fluid in this manner enables the FCD model to provide that the oil and gas stay unchanged at each stage of the FCD.

Detailed FCD Model

In order to accommodate the effects of phase transitions, it may be possible to estimate the performance of the FCD as a cascade of orifices applying enthalpy steam flash calculations in the spaces between orifices. For each orifice one can use a flow resistance (K) term appropriate for the expected flow regime with a non-Darcy (flow rate squared) term. The computation has been done for water without using the reservoir simulator and was verified experimentally. On emulsions there should be an inert component, the bitumen, and a separate water component so again a proper K term should be identified.

The change in pressure may cause some amount of water to flash to vapor if it causes the fluid to cross the liquid to gas transition of the fluid's transition diagram. The mass fraction that will be converted to vapor may be calculated:

$$\frac{h_{f@higherP} - h_{f@lowerP}}{h_{fg@lowerP}} \quad \text{Eq. 10}$$

Where:

$h_{f@higherP}$=specific enthalpy of the fluid at the higher pressure in kJ/kg $h_{f@lowerP}$=specific enthalpy of the fluid at the lower pressure in kJ/kg $h_{fg@lowerP}$=latent heat of evaporation of the fluid at the lower pressure in kJ/kg The volume of fluid will increase as the vapor phase occupies more volume than the liquid phase which will in turn cause the velocity of the fluid to increase as the greater volume will need to pass through the same area in the next slot. This change would be taken into account in the ΔP computation of the succeeding slot and so on.

The concept for modeling FCDs is to treat the model as a series of slots followed by chambers. The ΔP of each slot is estimated as previously discussed. The total ΔP for the device would be:

$$\Delta P_{total}=\Delta P_{slot\ 1}+\Delta P_{chamber\ 1}+\Delta P_{slot\ 2}+\Delta P_{chamber\ 2}+\ldots+\Delta P_{slot\ n}+\Delta P_{chamber\ n} \quad \text{Eq. 11}$$

The chambers are where one would account for the flashing. It is unclear if the chambers will contribute much ΔP on their own so it is assumed they are frictionless and will not. The same equations would apply as for the slot albeit with a different K and A. If their area is significantly larger, the A2 in the denominator by itself may render the contribution negligible. By leaving the number of stages n variable, it will be adequate to estimate ΔP, then factor in the effects of flashing and iterate n times.

Successive Orifices Flash Computations

Modeling the FCD as a series of chokes separated by frictionless chambers with the fluid properties adjusted between slots to account for the steam that is flashed at each step is known to be an oversimplification. For example, a single choke would seem to be insensitive to steam flashing across it which is known not to be correct. There is steam flashed at each step of the process. It is also known that the chambers between slots are not frictionless and that the torturous nature of the path creates turbulence and other effects that influence the resulting ΔP and thus the amount of flashing.

The water mass fraction that is converted to steam at each intermediate stage of the multi-slot model of the FCD was initially estimated using Equation 10. A factor Sk is introduced to compensate for other effects resulting in the following:

$$\frac{(h_{f@higherP} - h_{f@lowerP})\times Sk}{h_{fg@lowerP}} \quad \text{Eq. 12}$$

Where:

$h_{f@higherP}$=specific enthalpy of the fluid at the higher pressure in kJ/kg $h_{f@lowerP}$=specific enthalpy of the fluid at the lower pressure in kJ/kg $h_{fg@lowerP}$=latent heat of evaporation of the fluid at the lower pressure in kJ/kg Sk=a dimensionless scaling factor to the steam fraction Sk is intended to summarize many factors so is not related to any one physical phenomenon in particular. It is adjusted in the process of training the model.

Steam Quality

The first model that was built uses an arbitrary series of slots followed by frictionless chambers. When the vapor fraction increases, the density decreases, the viscosity changes and the fluid velocity increases. These effects can all be estimated to yield the fluid properties going into a second choke. The process is repeated an arbitrary number of times. The number of times and the properties of each choke can be determined based on physical properties of the FCD or they can be fitted to match data from a laboratory or field test, or from other means of determining tool performance.

The first implementation assumed all the chokes in series behave the same. An alternate implementation can take in a different description for each choke. Yet another alternate implementation can address steam differently. It can scale the value of K depending on the steam fraction. In other words, instead of making k a function of Re, it makes it a arbitrary function of Re and Vapor Fraction that can be fit to the behavior that matches the FCD performance.

In this model the fluid can be water, oil, or any other fluid or mix thereof. The vapor is the gaseous phase of such fluids.

The steam fraction at each intermediate stage of the multi-slot model of the FCD was initially estimated using the following thermodynamic equation:

(StageEnthalpyIn−StageEnthalpyOut)/(StageSteamEnthalpyOut−StageEnthalpyOut)

in the refined model it is:

(StageEnthalpyIn−StageEnthalpyOut)/(StageSteamEnthalpyOut−StageEnthalpyOut)*$K$ where K is the scaling factor for the amount of steam that is released between the stages.

A tuning parameter scales the amount of steam liberated when pressure drops across the FCD. The steam increase becomes:

$Sk$*(StageEnthalpyIn−StageEnthalpyOut)/(StageSteamEnthalpyOut−StageEnthalpyOut)

Sk was taken to be a constant. This works adequately for low steam fraction but fails as the steam fraction increases. Sk was made a function of the Steam Fraction and two parameters were used to tune it, $S_{k1}$ and $S_{k0}$. $S_{k1}$ is a number between 0 and 1 and $S_{k0}$ is a positive number:

```
If SteamFraction < Sk1 Then
Sk = (1 − (SteamFraction / Sk1)) ^ Sk0 + ((SteamFraction / Sk1) ^ Sk0) *
(1 − Sk1)
Else
Sk = (1 − Sk1) * (((1 − SteamFraction ) / (1 − Sk1)) ^ Sk0)
```

Steam quality may then be calculated using the following estimate:

For $SQ<0, C=0$

For $SQ<S_{k1}, C=SQ/S_{k1}\cdot S_{k1}+(1-S_{k1})$

For $S_{k1}=1, C=0$

For $S_{k1}\neq 1, C=(SQ-S_{k1})/(1-S_{k1})\cdot(1-S_{k1})$

Where

SQ is Steam Quality $S_{k1}$ is steam fraction parameter 1 between 0 and 1, and

Sk0 is steam fraction parameter 2 greater than zero.

Black Box Model

The multi-slot refinement was intended to more closely model the physics of the FCD. As noted above, some deviations were expected due to some of the simplifying assumptions that were made. The model is trained on the data in order to minimize the prediction error but the closer a model matches the physics, the better the model should work. The Select FCD has 9 chambers so it was thought that 9 successive flash computations would best fit the data (n=9). The best results were obtained by using only 2 steps of flash computation (n=2). While unexpected, the result is welcome. It furthers the goal to model FCDs as black boxes independent of internal architecture. The final model developed used the following parameters:

| | | | | | |
|---|---|---|---|---|---|
| n | 2 | a1 | 0.007118704 | c | 1.405507151 |
| Sk | 0.616898904 | a2 | 1.278922809 | d | 0.05449507 |
| d | 3.712335032 | b1 | 0.238248119 | t | 3.60271E−06 |
| | | b2 | 0.000186341 | | |

The resulting performance had a median error of 0.47 psi and a maximum error of 4.35 psi on 34.63 psi or 13%. The median error is close to the loop measurement error so the results are deemed very good. The model next needs to be enhanced to address water cuts other than 0% or 100% as it is not yet proven with emulsions.

Implementation

In one embodiment, the model is built as an Excel VBA application. There are routines to implement the various equations. They are used as native operations in Excel spreadsheets which are used as databases to hold the measurements and as data manipulation tools. The data from the tests, both the parameters and the results, are stored in columns with each row representing a different datapoint. The parameters to a model are also stored in cells in a spreadsheet so the model can be configured without changing the underlying VBA code.

One of the benefits of storing the model parameters as cells in a spreadsheet is that Excel Solver functionality can be used to optimize the model. Solver is set to minimize error by changing all the relevant model parameters. The error that is minimized can be the mean square error, the median error or the maximum error. The model is highly non-linear so Solver settles on local solutions. Better solutions require disturbing the model. This can be done by varying some parameters, and letting Solver resolve while optimizing some parameters and keeping others constant or alternating error criteria.

In order to support SAGD well design one must have the ability to simulate the performance of the completion. This implies addressing 2 different challenges:

- Predict the ΔP through an FCD given the fluid properties and flow rate
- Simulate the impact of the FCD on the reservoir which implies modeling both the wellbore hydraulics and the movement of fluids through the reservoir In another embodiment, reservoir simulation of thermal applications is conducted using STARS with FLEXWELL to address not only the reservoir but also the hydraulics in the wellbore. Using STARS+FLEXWELL and the appropriate FCD ΔP models, it provides a unique and powerful method to accurately model FCD behavior during a thermal recovery process.

Although the systems and processes described herein have been described in detail, it should be understood that various changes, substitutions, and alterations can be made without departing from the spirit and scope of the invention as defined by the following claims. Those skilled in the art may be able to study the preferred embodiments and identify other ways to practice the invention that are not exactly as described herein. It is the intent of the inventors that variations and equivalents of the invention are within the scope of the claims, while the description, abstract and drawings are not to be used to limit the scope of the invention. The invention is specifically intended to be as broad as the claims below and their equivalents.

A large list of free geophysics software is published at en.wikipedia.org/wiki/List_of_free_geophysics_software and is incorporated by reference herein in its entirety.

Hardware may preferably include massively parallel and distributed Linux clusters, which utilize both CPU and GPU architectures. Alternatively, the hardware may use a LINUX OS, XML universal interface run with supercomputing facilities provided by Linux Networx, including the next-generation Clusterworx Advanced cluster management system.

Another system is the Microsoft Windows 7 Enterprise or Ultimate Edition (64-bit, SP1) with Dual quad-core or hex-core processor, 64 GB RAM memory with Fast rotational speed hard disk (10,000-15,000 rpm) or solid state drive (300 GB) with NVIDIA Quadro K5000 graphics card and multiple high resolution monitors. Slower systems could be used, but are less preferred since such modeling is already compute intensive. Furthermore, different software packages may be optimized for different system requirements, and this should be taken into account.

The following references are incorporated by reference in their entirety for all purposes.

Zeng G., et al. Comparative Study on Passive Inflow Control Devices by Numerical Simulation, Tech Science Press SL 9(3): 169-180 (2013), available online at techscience-.com/doiI10.3970/sI.2013.009.169.pdf Youngs, B. et aI., Multisegment well modeling optimizes inflow control devices, World Oil (May 2010), p. 37-42, available online at slb.com/-/media/Files/sand_control/industry articles/201 005_wo_inflow control_devices.pdf.

Vasily Mihailovich Birchenko, Analytical Modelling of Wells with Inflow Control Devices (PhD Thesis 2010), available online at ros.hw.ac.uk/bitstream/10399/2349/1/Birchenko V 071O_pe.pdf.

US20140262235 Method of optimization of flow control valves and inflow control devices in a single well or a group of wells.

What is claimed is:

1. A method of optimizing the inflow control device (ICD) design in a reservoir, said method comprising:

a) inputting reservoir feature attributes from a reservoir including permeability, porosity, viscosity, temperature, and pressure;

b) inputting well configuration attributes from said reservoir including well length, diameter, slot size, branching, depth, vertical and lateral separation between producer wells and injector wells, and relative orientation of producer wells and injector wells;

c) inputting enhanced oil recovery attributes from said reservoir including steam injection rate, steam quality, steam temperature, and steam injection pressure;

d) inputting variable attributes for an ICD including number of orifices or channels, diameter of orifices or channels, number of bends, and degree of bending;

e) inputting an objective function containing desired performance characteristics;

f) applying a function Fq to combine all attributes into a figure of merit for ICD and comparing with said objective function in step e; and g) applying an optimizer algorithm to generate an optimal Fq for the inputted attributes, wherein the variable attributes in step d) are varied so that said optimal Fq most closely approaches the objective function in step e.

2. The method of claim 1, wherein the figures of merit include flow rate sensitivity, viscosity sensitivity, and steam block efficiency.

3. The method of claim 1, wherein the figures of merit include density sensitivity.

4. An ICD designed by the methods of claim 1.

5. A well completed with one or more ICDs designed by the methods of claim 1.

6. A method of optimizing the inflow control device (ICD) design for a reservoir, said method comprising:

a) inputting into a computer program a plurality of reservoir feature attributes from a reservoir including permeability, porosity, viscosity of oil in place, downhole temperature, downhole pressure, and geologic model;

b) inputting into said computer program a plurality of well configuration attributes from said reservoir including well length, diameter, slot size, branching, depth, vertical and lateral separation between producer wells and injector wells, undulations, relative orientation of producer wells and injector wells, number and type of ICDs used, configuration of production tubing, and artificial lift system;

c) inputting into said computer program a plurality of enhanced oil recovery attributes from said reservoir including steam injection rate, steam quality, steam injection pressure, steam injection temperature, and percentage of solvent coinjected;

d) inputting into said computer program a plurality of variable attributes for an ICD including number of orifices, number of channels, diameter of orifices, diameter of channels, number of bends, degree of bending, and rugocity;

e) inputting into said computer program one or more objective functions containing desired performance characteristics;

f) applying in said computer program a function Fq to combine all attributes into one or more figures of merit and comparing with said objective function in step e, wherein said figures of merit include at least flow rate sensitivity, viscosity sensitivity, and steam block efficiency; and g) optimizing in said computer program to generate an optimal Fq for the inputted attributes, wherein the variable attributes in step d) are varied so that said optimal Fq most closely approaches the objective function in step e.

7. The method of claim 6, further comprising manufacturing a plurality of optimal ICDs employing said optimal Fq.

8. The method of claim 7, further comprising installing said manufactured ICDs in said reservoir.

9. An ICD designed by the method of claim 6.

10. A well completed with one or more ICDs designed by the method of claim 6.

* * * * *